US005613313A

United States Patent [19]

Homan et al.

[11] Patent Number: 5,613,313

[45] Date of Patent: Mar. 25, 1997

[54] USER MODIFIABLE DATE DISPLAY UNIT

[76] Inventors: Deanna I. Homan; Kenneth T. Homan, both of 20606 Gibraltar Rd., Brownstown, Mich. 48183

[21] Appl. No.: 539,359

[22] Filed: Oct. 5, 1995

[51] Int. Cl.[6] ..... G09F 11/15

[52] U.S. Cl. ..... 40/524

[58] Field of Search ..... 40/524, 446, 525

[56] References Cited

U.S. PATENT DOCUMENTS

| | | | |
|---|---|---|---|
| 488,411 | 12/1892 | Wyman | 40/524 X |
| 531,679 | 1/1895 | Gros | 40/524 X |
| 835,844 | 11/1906 | Bewan | 40/524 X |
| 1,450,850 | 4/1923 | Grip | 40/524 X |
| 1,653,312 | 12/1927 | Rouprich | 40/524 |
| 1,812,600 | 6/1931 | Martin | 40/524 |
| 2,774,160 | 12/1956 | Gilson . | |
| 2,833,068 | 5/1958 | Parker . | |
| 3,970,988 | 7/1976 | Gilmore | 40/524 X |
| 4,026,051 | 5/1977 | Scharrer . | |
| 4,308,678 | 1/1982 | Slobin . | |

FOREIGN PATENT DOCUMENTS

| | | | |
|---|---|---|---|
| 1028330 | 5/1953 | France | 40/524 |

*Primary Examiner*—Joanne Silbermann
*Attorney, Agent, or Firm*—Joseph N. Breaux

[57] ABSTRACT

A modifiable date display unit including a plastic housing having an internal chamber and at least four indicia apertures formed through a surface thereof into the internal chamber; a spring biased clip mechanism secured to the plastic housing; four independently positionable indicia display loops disposed within the internal chamber of the plastic housing in a manner such that a desired indicia may be positioned within the internal chamber at a location allowing the viewing of the indicia through one of the indicia apertures; and four loop positioning mechanisms.

1 Claim, 3 Drawing Sheets

USER MODIFIABLE DATE DISPLAY UNIT

TECHNICAL FIELD

The present invention relates to devices used to indicate the expiration of foodstuffs and more particularly to a user modifiable date display unit that includes a plurality of flexible loops having numerical indicia disposed on a surface thereof positionable by a user in a manner to indicate a desired day and month.

BACKGROUND ART

Various manufacturer packaged items such as lunch meats, cheeses, milk etc. are provided with a freshness expiration date at the time of packaging to indicate to consumers when the items are no longer at a desirable freshness level. However, many items, such as delicatessen type lunch meats and cheeses, eggs and other items typically removed from their purchase containers after purchase, do not have such a freshness indicator available to indicate to the consumer when the items are no longer at a desirable freshness level. It would be a benefit, therefore, to have an indicator device securable to or adjacent an item that could be adjusted by a user to indicate an expiration date for the wholesome consumption of a product. Because such products often require storage under refrigerated conditions, it would be a benefit if the indicator could be exposed to cold, humid conditions without hindering operation of the device. In addition, because the indicator device should be useable with a variety of items, it would be a benefit if the indicator device included at least two mechanisms for securing the indicator to or adjacent items. It would be further benefit, if the indicator had four separate indicators to minimize the time required to set a proper expiration date.

GENERAL SUMMARY DISCUSSION OF INVENTION

It is thus an object of the invention to provide a modifiable date display unit that may be exposed to humid conditions for an extended period of time without hindering operation of the unit.

It is a further object of the invention to provide a modifiable date display unit that is securable within a refrigerator by at least two attachment mechanisms.

It is a still further object of the invention to provide a modifiable date display unit that includes at least four user positionable indicators for indicating a desired month and date.

It is a still further object of the invention to provide a modifiable date display unit that accomplishes all or some of the above objects in combination.

Accordingly, a modifiable date display unit is provided. The display unit includes a plastic housing having an internal chamber and at least four indicia apertures formed through a surface thereof into the internal chamber; a spring biased clip mechanism secured to the plastic housing; four independently positionable indicia display loops disposed within the internal chamber of the plastic housing in a manner such that a desired indicia may be positioned within the internal chamber at a location allowing the viewing of the indicia through one of the indicia apertures; and four loop positioning mechanisms. If desired, a section of magnetic material may be affixed to the display unit to provide a secondary mechanism for securing the display unit to or adjacent an item.

Each indicia display loop includes a protruding portion running the entire length thereof having a plurality of notches formed thereon in the manner of a gear. Each loop positioning mechanism includes a pair loop stretching rods and a positioning wheel having a geared portion that meshes with the notches of the display loop in a manner to allow rotation of the positioning wheel to move the display loop to a desired position.

The four loop positioning mechanisms preferably share a common pair of loop stretching rods over which the display loops are stretched. It is also desirable to use a common wheel rod upon which the four positioning wheels are rotatably mounted.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
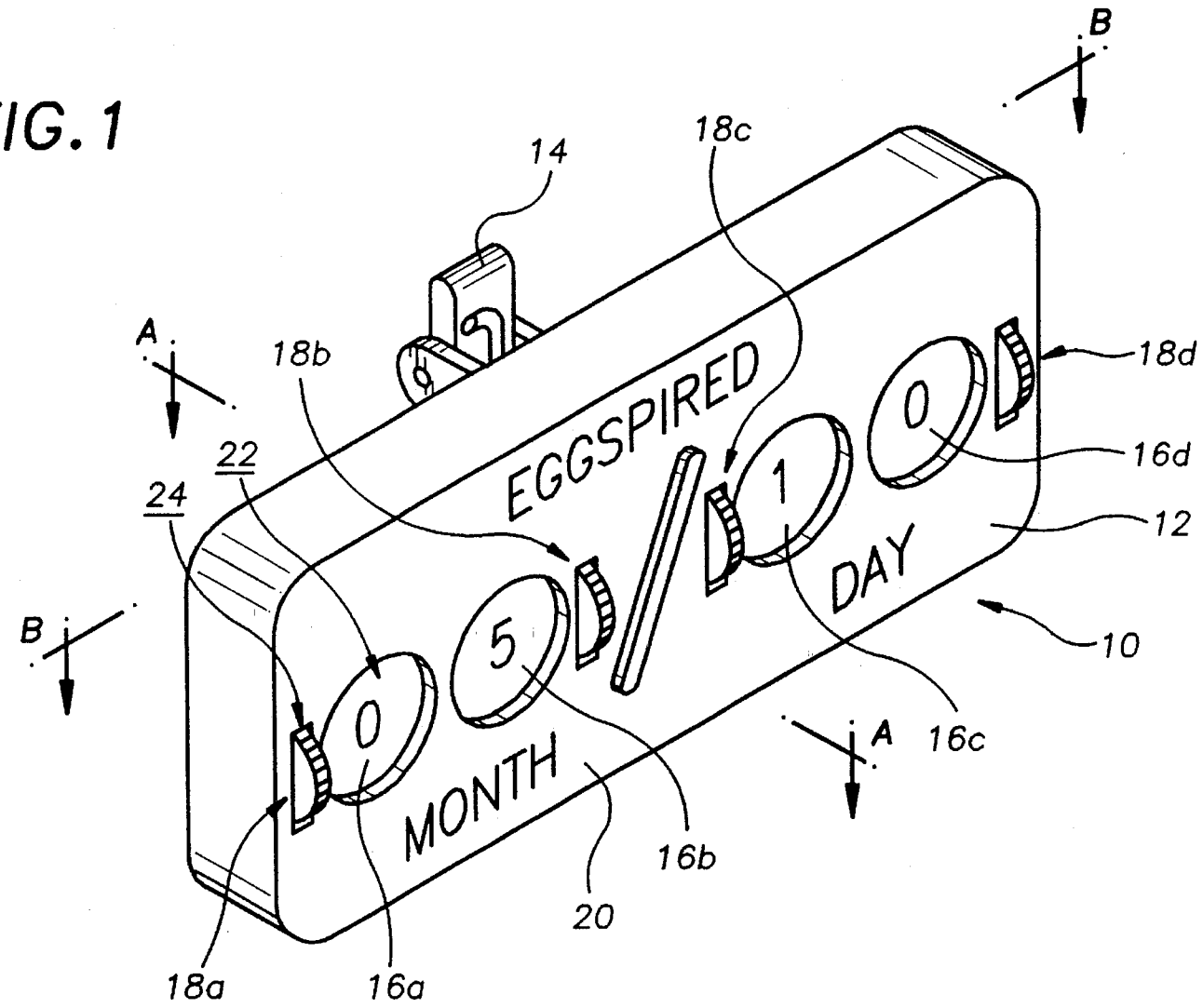
FIG. 1 is a perspective view of an exemplary embodiment of the modifiable display unit of the present invention.

FIG. 1 shows an exemplary embodiment of the user modifiable display unit of the present invention generally designated by the numeral 10. As shown, display unit 10 includes a plastic housing 12; a spring biased clip mechanism 14; four independently positionable indicia display loops 16*a–d*; and four loop positioning mechanisms, generally designated by the designations 18*a–d*.

Plastic housing 12 is a substantially parallelepiped shaped container having rounded corners and is about two and one-half (2½") inches long, one (1") inch wide, and about one-half (½") inch thick. A front face 20 of plastic housing 12 has four circular display apertures 22 and four rectangular positioning wheel apertures 24 formed therethrough to allow viewing of the four display loops 16*a–d* and user access to the four loop positioning mechanisms 18*a–d*, respectively. Each display loop 16*a*–16*d* has the numerals zero through nine marked sequentially on the outwardly projecting surface thereof.

Figure 2:
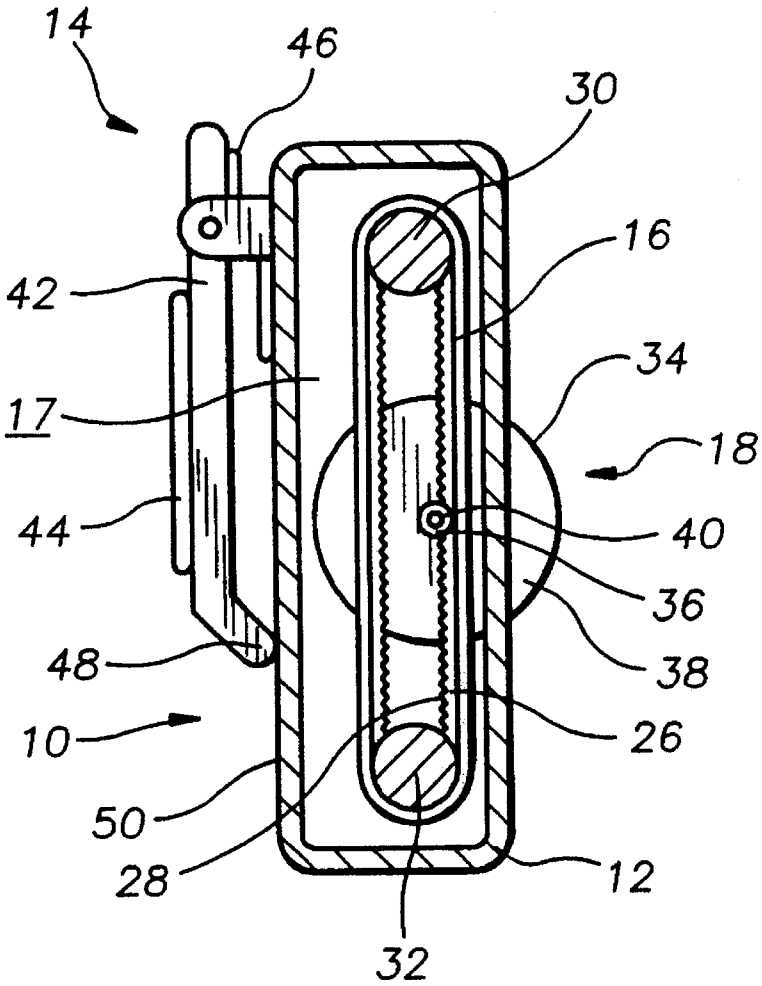
FIG. 2 is a cross-sectional view of the modifiable display unit of FIG. 1 along the line A—A showing one of the four flexible loop positioning mechanisms.

FIG. 2 is a cross-sectional view of display unit 10 through housing 12 along the line A—A of FIG. 1 showing a side view of a display loop 16 and a loop positioning mechanism 18 positioned within internal chamber 17. Display loop 16 is a continuous closed loop of flexible plastic having an internally protruding ring 26 having a plurality of gear notches 28. Loop positioning mechanism 18 includes a pair of loop stretching rods 30,32 over which display loop 16 is stretched in a manner that allows display loop 16 to move with respect to stretching rods 30,32. Loop positioning mechanism 18 also includes a positioning wheel 34 having a loop engaging gear 36 concentrically attached thereto and extending from a side surface 38 thereof. Positioning wheel 34 is rotatably mounted to a wheel rod 40. Wheel rod 40 is located adjacent display loop 16 to allow loop engaging gear 36 to mesh with gear notches 28 of ring 26.

Also shown in the figure is a side view of clip mechanism 14 including a clip member 42 having a section of rubberized magnet 44 attached to a back surface thereof and a torsion spring 46 engaged therewith to keep a tip 48 biased against back surface 50 of housing 12.

Figure 3:
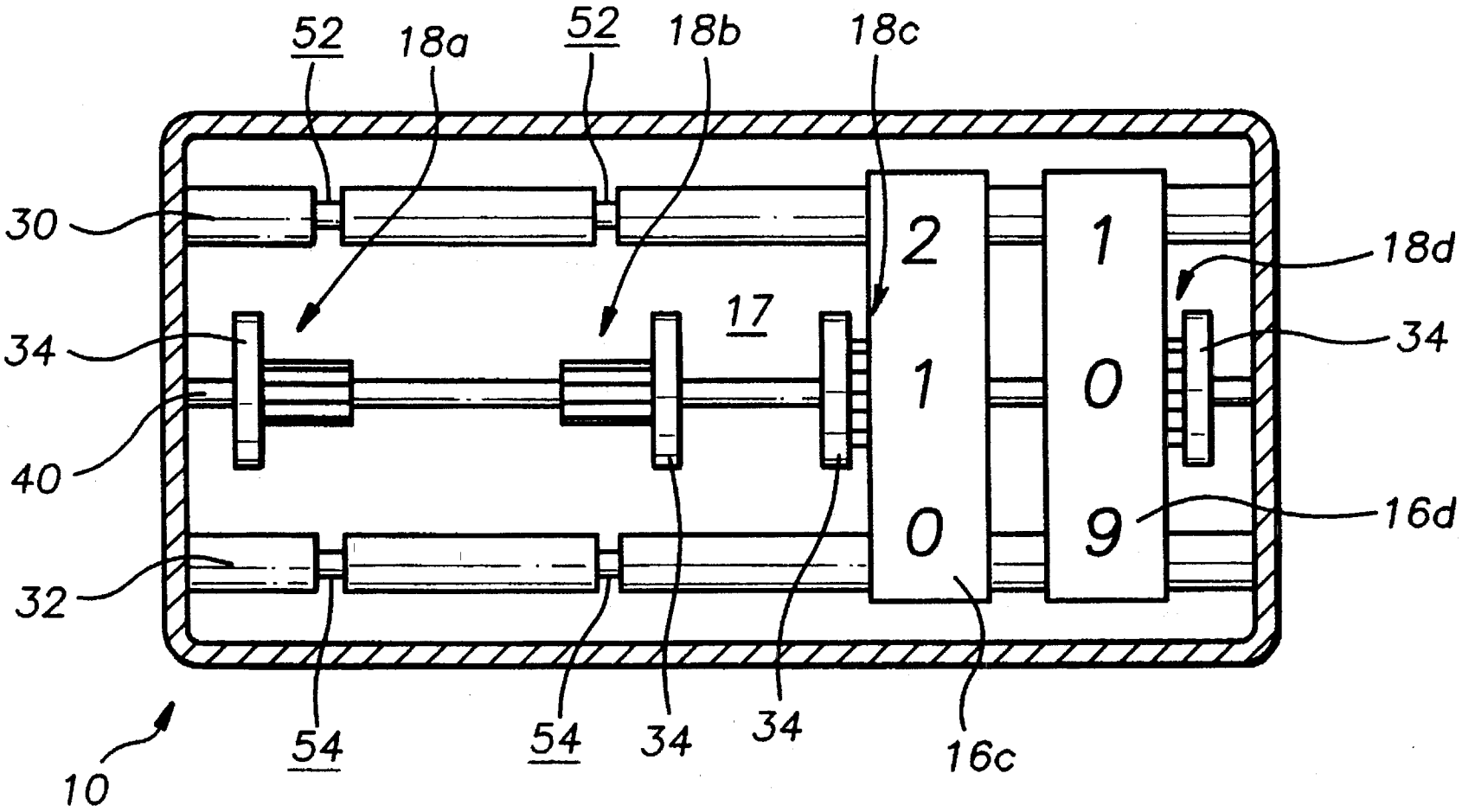
FIG. 3 is a cross-sectional view of the display unit of FIG. 1 along the line B—B showing two of the positioning mechanisms with the flexible loops removed and two with the flexible loops in place.

FIG. 3 is a cross-sectional view of display unit 10 along the line B—B of FIG. 1 showing two of the four positioning mechanisms 18*c*, 18*d* with display loops 16*c*, 16*d* in place and two positioning mechanisms 18*a*, 18*b* with display loops 16*a*, 16*b* not shown. As shown in the figure, the four positioning mechanisms 18*a*–18*d* share a single, parallel oriented, pair of loop stretching rods 30,32. Each stretching rod 30,32 includes four circumferential ring channels 52,54 respectively. Ring 26 (FIG. 2) from each display loop 16 travels within each pair of ring channels 52,54 preventing display loop 16 from moving laterally with respect to stretching rods 30,32. In addition, the four positioning wheels 34 are rotatably mounted to a common wheel rod 40. Wheel rod 40 and stretching rods 30,32 are constructed of plastic and are adhesively secured within internal chamber 17 after positioning wheels 34 and display loops 16 are, respectively, in position.

An exemplary use of user modifiable display unit 10 in conjunction with a carton of eggs is now described with general reference to FIGS. 1–3. The individual eggs packaged within the carton are removed and placed on the egg storage shelf provided in most refrigerators. The expiration date provided on the carton is noted and the month and date transferred to display unit 10 by rotating positioning wheels 34 of loop positioning mechanisms 18*a*–18*d* until the appropriate numerals are visible through display apertures 22. Display unit 10 is then positioned adjacent the egg storage shelf using magnet 44 or clipping housing 12 to an outwardly projecting surface with clip mechanism 14. Once the expiration date has been reached, a user will be able to discard the unused quantity of eggs without risking consumption of unwholesome eggs.

It can be seen from the preceding description that a modifiable date display unit has been provided that may be exposed to humid conditions for an extended period of time without hindering operation of the unit; that is securable within a refrigerator by at least two attachment mechanisms; and that includes at least four user positionable indicators for indicating a desired month and date.

It is noted that the embodiment of the modifiable date display unit described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A modifiable date display unit comprising:

a plastic housing having a front face having at least four display apertures and at least four positioning wheel apertures formed therethrough in connection with an internal chamber formed within said housing;

a spring biased clip mechanism secured to said housing, said clip mechanism including a section of rubberized magnet attached to a backside thereof;

four independently positionable indicia display loops constructed from a continuous closed loop of flexible plastic having an outwardly projecting surface bearing sequential indicia of the numerals zero through nine, each said display loop being disposed within said internal chamber, each said display loop including a protruding ring portion running the entire length thereof having a plurality of gear notches formed thereon; and four loop positioning mechanisms, one each in connection with one of said display loops in a manner such that movement of one of said positioning mechanisms causes a movement in a respective display loop; all of said loop positioning mechanisms sharing a common pair of parallel oriented loop stretching rods, each said loop positioning mechanism including a separate positioning wheel having a geared portion that extends from a sidewall of said positioning wheel and is concentrically attached thereto, each said positioning wheel being rotatably mounted on a common gear rod located adjacent said display loops in a manner to allow said geared portion of each of said positioning wheels to mesh with said gear notches of a respective display loop, rotation of one of said positioning wheels moving one of said display loops to a desired position, each said stretching rod of said pair of loop stretching rods includes four circumferential ring channels, each circumferential ring channel being sized to receive a said protruding ring portion from one of said display loops, each protruding ring portion traveling within a pair of ring channels, one from each stretcher rod, each said ring channel preventing each display loop from moving laterally with respect to either of said stretching rods, said wheel rod and said pair of stretcher rods being adhesively secured within said internal chamber.

* * * * *